US005201192A

United States Patent [19]

Hara

[11] Patent Number: 5,201,192

[45] Date of Patent: Apr. 13, 1993

[54] WATER DROPLET COLLECTOR

[75] Inventor: Yasuo Hara, Shimane, Japan

[73] Assignee: Hoshizaki Denki Kabushiki Kaisha, Japan

[21] Appl. No.: 721,341

[22] Filed: Jul. 1, 1991

[30] Foreign Application Priority Data

| | | | |
|---|---|---|---|
| Jun. 29, 1990 | [JP] | Japan | 2-173970 |
| Jun. 29, 1990 | [JP] | Japan | 2-173971 |
| Jul. 3, 1990 | [JP] | Japan | 2-175585 |
| May 20, 1991 | [JP] | Japan | 3-145618 |
| May 23, 1991 | [JP] | Japan | 3-149636 |
| May 24, 1991 | [JP] | Japan | 3-149884 |

[51] Int. Cl.[5] ..... F25D 21/14

[52] U.S. Cl. ..... 62/285; 62/281

[58] Field of Search ..... 62/272, 285, 288, 281, 62/283, 291

[56] References Cited

U.S. PATENT DOCUMENTS

| | | | |
|---|---|---|---|
| 2,099,665 | 11/1937 | Smith | 62/272 |
| 4,198,222 | 4/1980 | Wood | 62/272 |
| 4,383,415 | 5/1983 | Jacob | 62/81 |

*Primary Examiner*—Albert J. Makay
*Assistant Examiner*—William C. Doerrler
*Attorney, Agent, or Firm*—Nikaido, Marmelstein, Murray & Oram

[57] ABSTRACT

A water droplet collector for collecting drops of dew condensed from the air onto cool surfaces in a high humid compartment such as a cooling storage cabinet formed to store perishable fresh foodstuffs therein. The water droplet collector is composed of a perforated thin plate and a base plate detachably overlapped with the perforated thin plate in such a manner as to form a capillary clearance for attraction of drops of dew condensed on the perforated thin plate. Both the plates are detachably mounted within the high humid compartment in such a manner that the base plate is arranged to receive drops of dew falling from a ceiling of the compartment.

4 Claims, 15 Drawing Sheets

Fig.6A
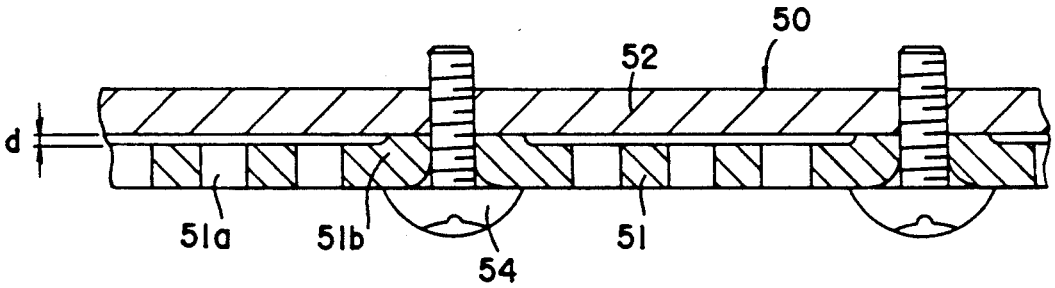
Fig.6B
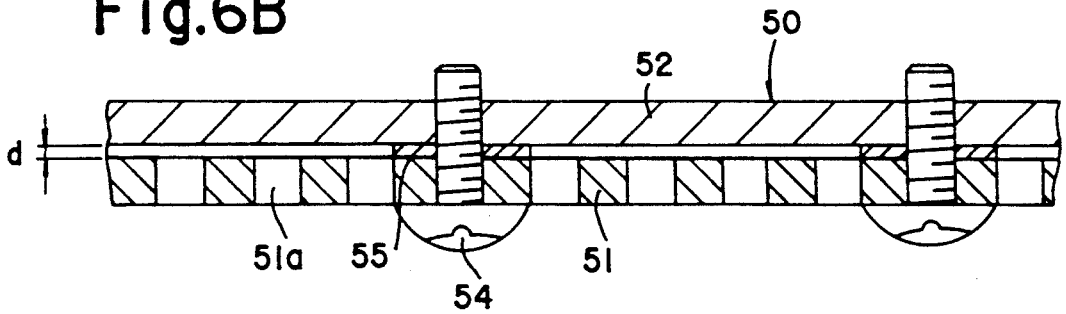
Fig.6C
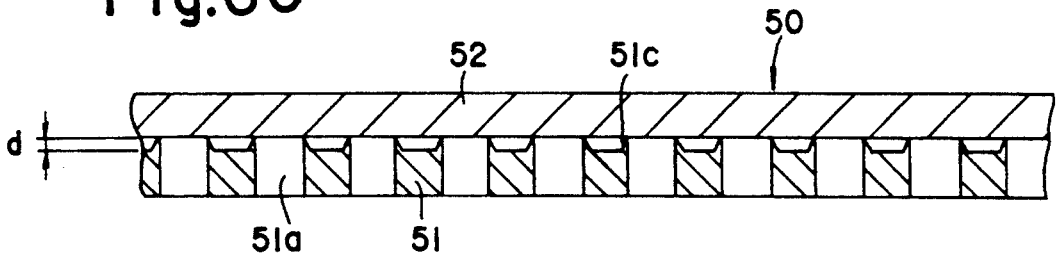
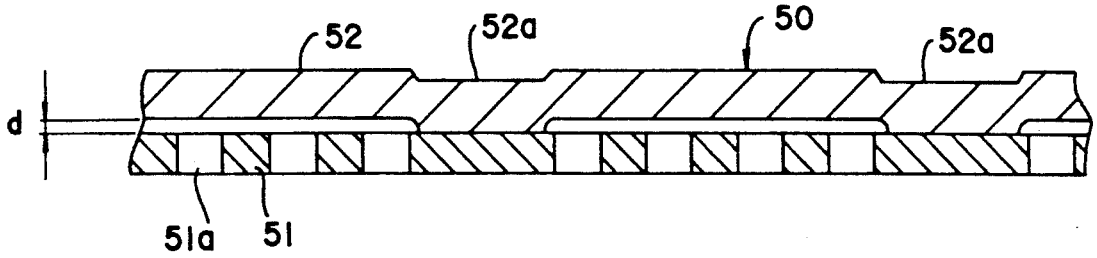
Fig.6D

Fig.12A
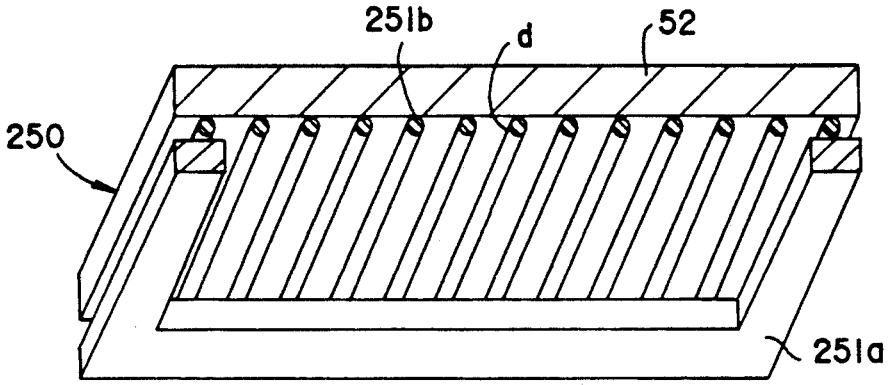
Fig.12B
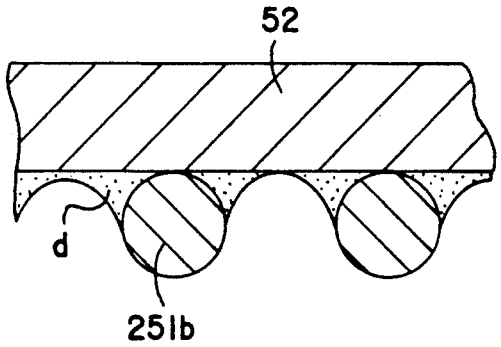
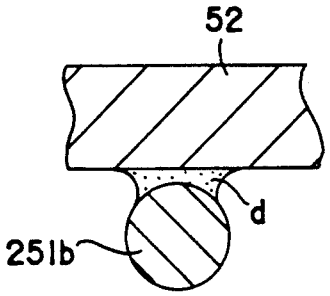
Fig.12C

WATER DROPLET COLLECTOR

BACKGROUND OF THE INVENTION

1. Field of the Invention

The present invention relates to a water droplet collector for collecting drops of dew condensed from the air onto cool surfaces in a high humid compartment such as a cooling storage cabinet formed to store perishable fresh foodstuffs or a bath room filled with vapor.

2. Description of the Prior Art

In Japanese Utility Model Laid-open Publication No. 64-41880 there has been proposed a water droplet collector adapted to a high humid cooling storage cabinet for perishable fresh foodstuffs. The water droplet collector is in the form of a dew receiving plate which is composed of a rectangular synthetic resin or metallic frame covered with a cloth of water absorptive fiber material or a rectangular perforated syntheric resin or metallic plate covered with a clotch of water absorptive fiber material. The dew receiving plate is mounted within a ceiling portion of the storage cabinet at an inclined angle. In the storage cabinet, drops of dew condensed from the air are absorbed into the water absorptive fiber material to be drained outwardly from the cabinet, while drops of dew condensed onto the ceiling of the cabinet are received by the receiving plate to be absorbed therein. The water retained in the water absorptive fiber material vaporizes to increase the relative humidity in the storage cabinet.

If the dew receiving plate is used for a long period of time, bacterium adhered to the water absorptive fiber material will breed to must the interior of the storage cabinet, and the smell of stored foodstuffs such as fish, meat or the like is absorbed into the water absorptive fiber material to cause unpleasant smell in the cabinet. To avoid such problems, the cloth of water absorptive fiber material has to be periodically washed for eliminating the must and smell. It is, however, very difficult to completely remove the must and smell from the cloth by washing. If brushed to mechanically remove the adhered must, the cloth of water absorptive fiber material will be damaged or broken.

SUMMARY OF THE INVENTION

It is, therefore, a primary object of the present invention to provide a water droplet collector which can be easily cleaned by washing causing any damage.

According to the present invention, the object is attained by providing a water droplet collector composed of a perforated plate and a base plate overlapped with one surface of the perforated plate in such a manner as to form a capillary clearance for attraction of drops of dew condensed on the other surface of the perforated plate, wherein both the plates are detachably mounted within a high humid compartment such as a cooling storage cabinet in such a manner that the base plate is arranged to receive drops of dew falling from a ceiling of the compartment.

In a practical embodiment of the present invention, the water droplet collector may be composed of a framework covered with a number of latticed wires and a base plate detachably overlapped with the latticed wires in such a manner as to form a number of capillary clearances for attraction of drops of dew condensed on the latticed wires. Alternatively, the water droplet collector may be composed of a framework covered with a number of parallel straight wires and a base plate detachably overlapped with the straight wires in such a manner as to form a number of capillary clearances for attraction of drops of dew condensed on the straight wires. Furthermore, the water droplet collector may be composed of a first perforated plate and a second perforated plate detachably overlapped with the first perforated plate in such a manner as to form a capillary clearance for attraction of drops of dew condensed on both the perforated plates.

BRIEF DESCRIPTION OF THE DRAWINGS

Additional objects, features and advantages of the present invention will be readily appreciated from the following detailed description of preferred embodiments thereof when taken together with the accompanying drawings, in which:

FIGS. 6A–6D illustrate methods for forming a capillary clearance between a base plate and a perforated thin plate;

FIG. 12A is an enlarged sectional view of the water droplet collector shown in FIGS. 10A and 10B;

FIGS. 12B and 12C each are an enlarged sectional view illustrating drops of dew condensed from the air onto the water droplet collector shown in FIG. 12A;

DESCRIPTION OF THE PREFERRED EMBODIMENTS

Figure 1:
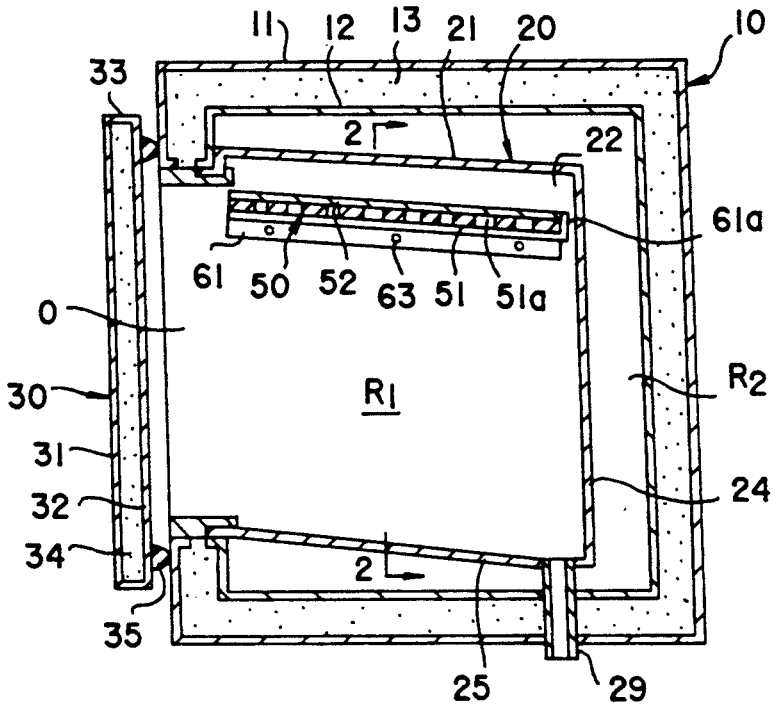
FIG. 1 is a sectional view of a high humid storage cabinet provided therein with a water droplet collector in accordance with the present invention.
Figure 2:
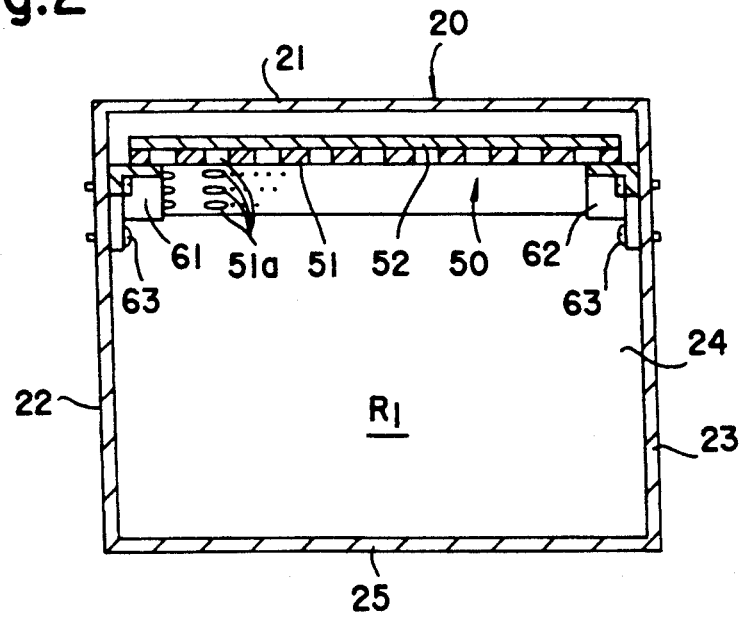
FIG. 2 is a sectional view taken along line 2—2 in FIG. 1.

In FIGS. 1 and 2 of the drawings, there is illustrated a box-type high humid storage cabinet provided therein with a water droplet collector 50 in accordance with the present invention. The storage cabinet includes a heat insulating box 10 formed at its front with an opening and an internal storage box 20 housed within the heat insulating box 10. The storage box 20 is made of sheet metal such as stainless steel plate and has an opening coupled with the opening of heat insulating box 10. The interior space R1 of storage box 20 is air-tightly closed by a heat insulating door 30 hinged at its one side to the front end of heat insulating box 10. The heat insulating box 10 is composed of an external box 11 formed at its front with an opening, an internal box 12 formed at its front with an opening and a heat insulating material 13 such as foamed urethane disposed between the external and internal boxes 11 and 12. The heat insulating door 30 is composed of a front panel 31, a rear panel 32 unitedly connected with the front panel 31 by means of a side plate 33 and a heat insulating material 34 such as foamed urethane disposed between the front and rear panels 31 and 32. An annular seal member 35 is secured to the rear panel 32 of door 30 for engagement with the front end of heat insulating box 10. Formed between the heat insulating box 10 and storage box 20 is a cool air circulating space R2 to be supplied with chilled air from a cool air supply system 40 as shown in FIG. 3.

Figure 3:
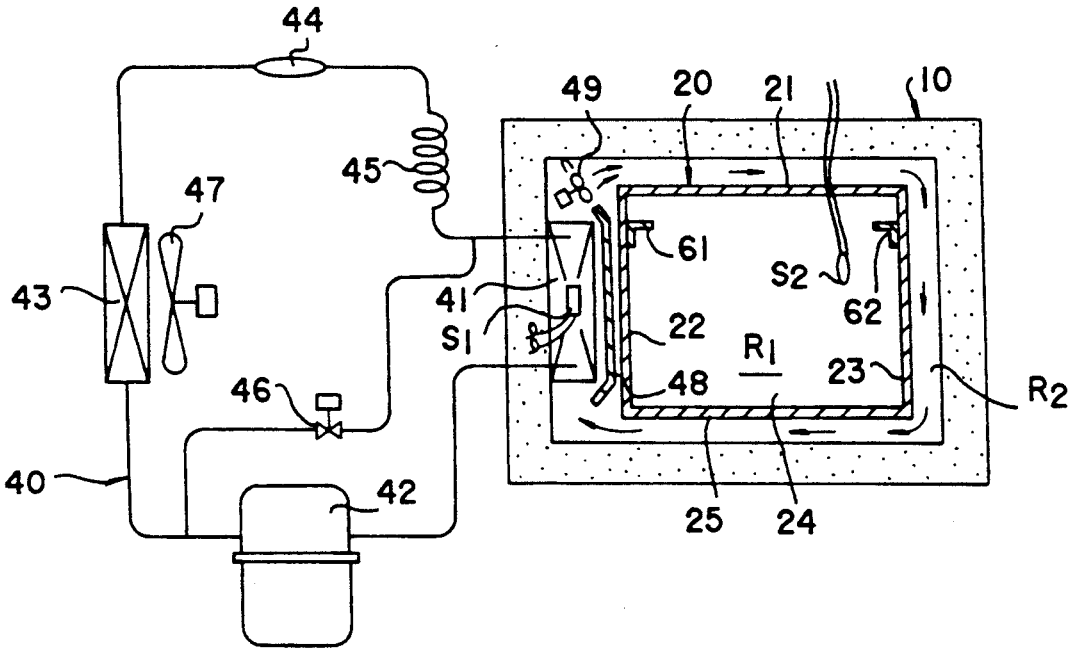
FIG. 3 illustrates a cool air supply system adapted to the storage cabinet.

As shown in FIG. 3, the cool air supply system 40 includes an evaporator 41 mounted to an internal left wall of heat insulating box 10, a compressor 42 arranged outside the heat insulating box 10 and connected to the evaporator 41, a condenser 43, a dryer 44 and a capillary tube 45 connected in series to the compressor 42 for providing a freezing circuit therewith, an electrically operated hot gas valve 46 disposed within a bypass circuit of the freezing circuit, and an electric motor-driven cooling fan 47 for cooling the condenser 43. The evaporator 41 is surrounded by a cover member 48 which is formed with an opening at its upper portion. An electric motor-driven blower 49 is arranged within the opening of cover member 48 to supply chilled air from the evaporator 41 into the cool air circulating space R2. The chilled air from blower 49 flows along the upper wall 21 of storage box 20 as shown by arrows and flows downward along the side wall 23 of storage box 20. The air further flows along the bottom wall 25 of storage box 20 and is circulated toward the evaporator 41 to be chilled. The cover member 48 is spaced from the side wall 22 of storage box 20 and secured to the front and rear walls of internal box 12 of heat insulating box 10 and to the upper wall of internal box 12.

The cool air supply system 40 further includes a defrost sensor S1 attached to the evaporator 41, a temperature sensor S2 disposed within the storage box 20, and an electric control apparatus (not shown) responsive to electric signals from the sensors S1 and S2. Under control of the electric control apparatus, the hot gas valve 46 is opened for a predetermined time in response to the electric signal from defrost sensor S1 to remove frost from the evaporator 41, and the compressor 42 is deactivated in response to the electric signal from temperature sensor S2 when the temperature in storage space R1 reaches a lower limit value and reactivated in response to the electric signal from temperature sensor S2 when the temperature in storage space R1 rises up to an upper limit value. The water caused by defrost of the evaporator 41 is received by a saucer (not shown) placed below the evaporator 41 and drained outwardly through a bottom portion of the heat insulating box 10.

Figure 4A:
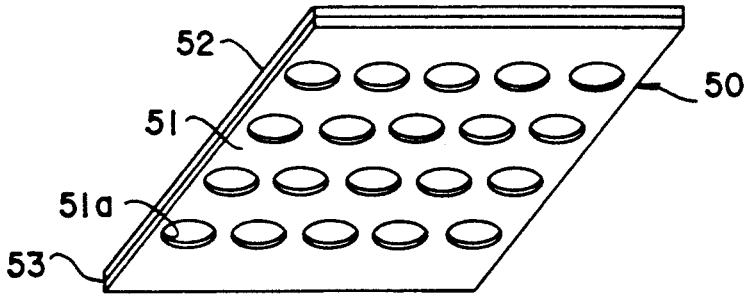
FIG. 4A is an enlarged perspective view of the water droplet collector shown in FIG. 1.
Figure 4B:
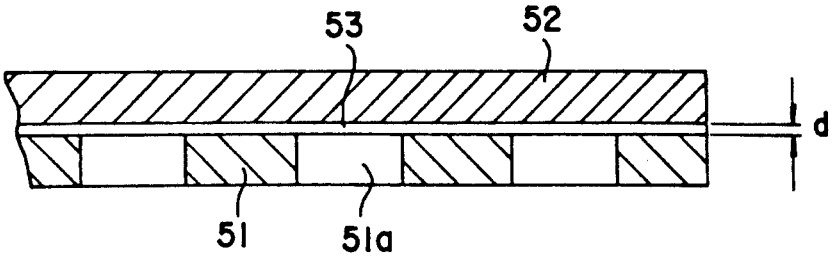
FIG. 4B is a sectional view of the water droplet collector shown in FIG. 4A.

As shown in FIGS. 1 and 2, the water droplet collector 50 is detachably mounted within a ceiling portion of the storage space R1 in box 20 and inclined rearward at an appropriate angle. As shown in FIGS. 4A and 4B, the water droplet collector 50 is composed of a perforated thin plate 51 formed with a number of through holes 51*a* and a base plate 52 detachably overlapped with one surface of the perforated thin plate 51 with a capillary clearance d of 0.1–0.6 mm. The capillary clearance d is formed by a shim plate 53 interposed between plates 51 and 52. The shim plate 53 is formed to extend a long the peripheries of both the plates 51, 52 except for the rear ends thereof. Thus, the capillary clearance d opens rearward at the rear ends of plates 51, 52. In the water droplet collector 50, it is preferable that the plates 51, 52 and 53 are made of stainless sheet metal or synthetic resin. As shown in FIG. 2, the water droplet collector 50 is formed slightly smaller in lateral width than the opening 0 of heat insulating box 10 closed by the heat insulating door 30 and is carried on a pair of laterally spaced support rails 61 and 62 in such a manner that the base plate 52 is opposed to the upper wall 21 of storage box 20. Thus, the water droplet collector 50 is arranged to be removed from the support rails 61, 62 in a fore-and-aft direction. As shown in FIGS. 1 and 2, the support rails 61, 62 are arranged in parallel with the upper wall 21 of storage box 20 and secured to the side walls 22 and 23 of storage box 20 by means of fastening screws 63. The support rails 61, 62 are formed respectively at their rear ends with an upright stopper 61*a* for positioning the water droplet collector 50 in place.

Assuming that an amount of perishable fresh foodstuffs such as fish, meat or vegetables are stored in the storage box 20, moisture vaporized from the foodstuffs is condensed as drops of dew onto the internal wall surfaces of storage box 20 and onto the water droplet collector 50. In this instance, drops of dew condensed onto the upper wall surface of box 20 are received by the upper surface of base plate 52 of water droplet collector 50 and flow rearward together with drops of dew condensed on the upper surface of base plate 52. Thus, the drops of dew falling from the rear end of base plate 52 flow down along the rear wall 24 of box 20 together with drops of dew condensed thereon, while drops of dew condensed on the side walls 22, 23 flow down toward the inclined bottom wall 25 of box 20 together with drops of dew condensed thereto. As a result, all the drops of dew are drained from the storage box 20 through a drain pipe 29.

Figure 5A:
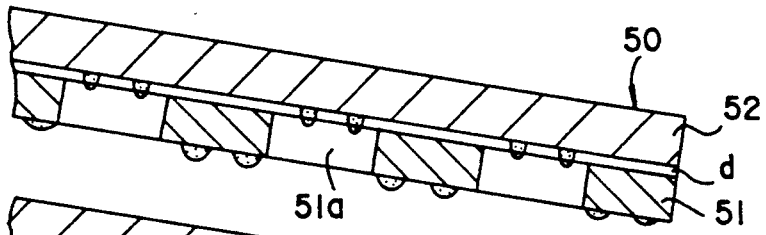
FIGS. 5A–5E illustrate a process from occurrence of drops of dew on the water droplet collector to disappearance of the drops of dew.
Figure 5B:
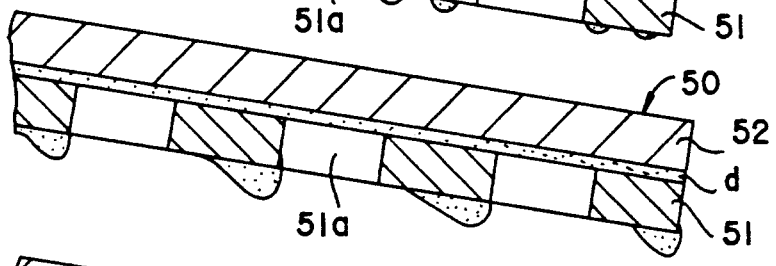
Figure 5C:
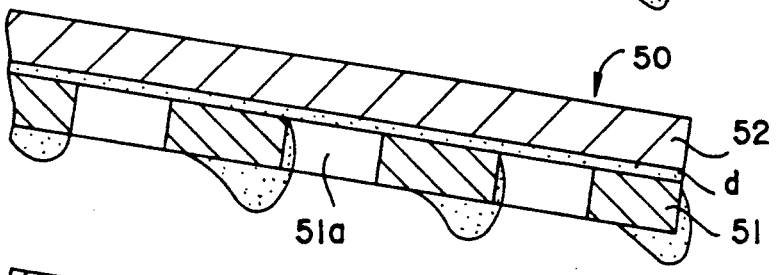
Figure 5D:
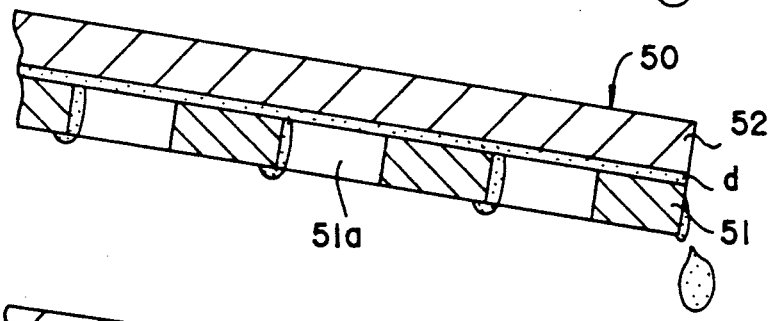
Figure 5E:
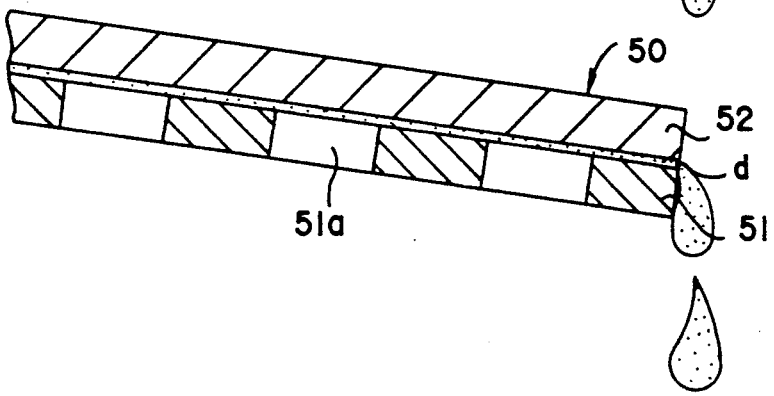

At the bottom of water droplet collector 50, drops of dew condensed on the perforated thin plate 51 are attracted into the capillary clearance d between plates 51, 52 and flow rearward through the capillary clearance d toward the rear wall 24 of box 20. Thus, the drops of dew from the capillary clearance flow down together with the drops of dew falling from the rear end of base plate 52 to be drained from the storage box 20 through the drain pipe 29. The attraction of the drops of dew into the capillary clearance d will be effected as illustrated in FIGS. 5A-5E. At an initial stage of condensation of the moisture, small drops of dew are condensed onto the bottom surfaces of plates 51 and 52 as shown in FIG. 5A. When the drops of dew gradually grow, the drops of dew on plate 52 are attracted into the capillary clearance d as shown in FIG. 5B, and the drops of dew on plate 51 are brought into contact with the capillary clearance d through the holes 51*a* in plate 51 as shown in FIG. 5C. Thus, the grown drops of dew on plate 51 are successively attracted into the capillary clearance d as shown in FIG. 5D. The drops of dew attracted into the capillary clearance d flow rearward along the bottom surface of plate 52 and fall from the rear end of plate 52 toward the drain pipe 29 as shown in FIG. 5E.

When grew as shown in FIG. 5C, the drops of dew on plate 51 tend to fall by their gravity. For this reason, the diameter of hole 51*a*, the space between holes 51*a*, the thickness of plate 51 and the inclined angle of water droplet collector 50 have been determined to effect sufficient surface tension for retaining the drops of dew on plate 51 against their gravity. The water retained in the capillary clearance vaporizes in accordance with decrease of humidity in the storage space R1 to restrain vaporization of moisture from the foodstuffs stored in the storage box 20 for maintaining the freshness of foodstuffs for a long period of time.

From the above description, it will be understood that the water droplet collector 50 is useful to protect the stored foodstuffs from drops of dew falling thereon in the high humid storage cabinet. For washing, the water droplet collector 50 can be removed from the support rails 61, 62 in the storage box 20, and the perforated thin plate 51 can be separated from the base plate 52. Thus, the plates 51, 52 and 53 can be cleaned by brushing to completely eliminate the must, smell and contaminants therefrom for maintaining the storage space R1 in a clean condition. Since the plates 51, 52 and 53 would not be damaged even if washed mechanically by brushing, the water droplet collector 50 can be reused for a long period of time.

Although in the water droplet collector 50 the shim plate 53 has been adapted to form the capillary clearance d between the plates 51 and 52, the perforated thin plate 51 may be pushed out at portions 51*b* for connection to the base plate 52 by means of screws 54 as shown in FIG. 6A. In this case, the capillary clearance d is formed by the pushed out portions 51*b* of plate 51 in engagement with the base plate 52. Alternatively, as shown in FIG. 6B, the capillary clearance d may be formed by annular spacers 55 interposed between the plates 51 and 52 at their portions connected by screws 54. In the case that burrs 51 are formed during the process of forming the holes 51*a* in the thin plate 51 of stainless sheet metal as shown in FIG. 6C, the capillary clearance d can be formed by the burrs of plate 51 in engagement with the base plate 52. In the case that the based plate 52 is pressed at portions 52*a* for connection to the perforated thin plate 51 by spot welding as shown in FIG. 6D, the capillary clearance d can be formed by the pressed portions 52*a* in engagement with the perforated thin plate 51.

Figure 7:
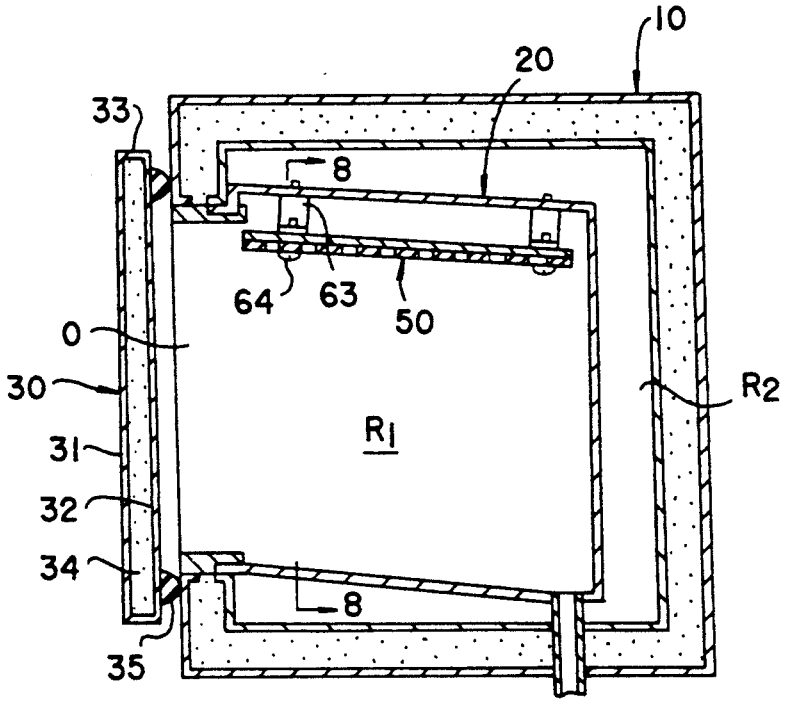
FIG. 7 is a sectional view of a modification of the high humid storage cabinet shown in FIG. 1.
Figure 8:
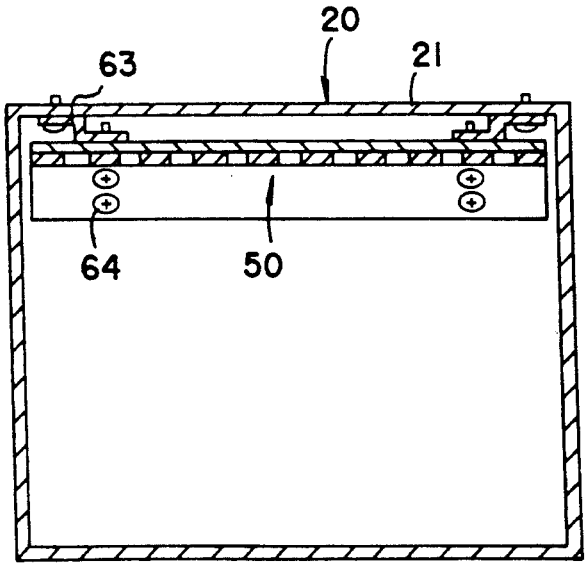
FIG. 8 is a sectional view taken along line 8—8 in FIG. 7.
Figure 9A:
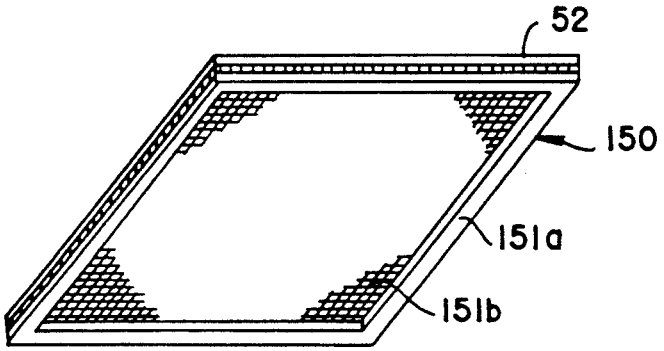
FIGS. 9A and 9B illustrate a modification of the water droplet collector shown in FIGS. 4A and 4B.
Figure 9B:
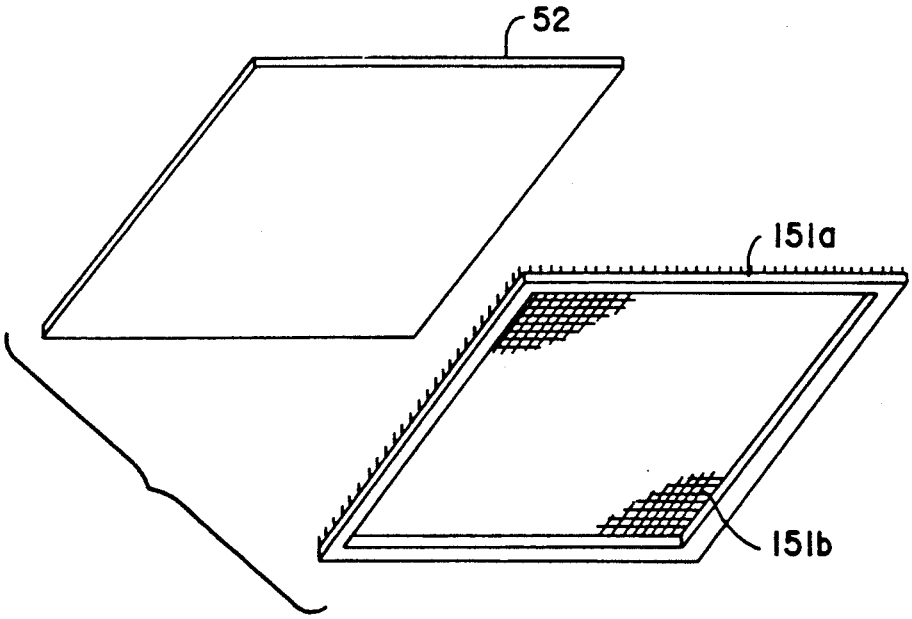
Figure 10A:
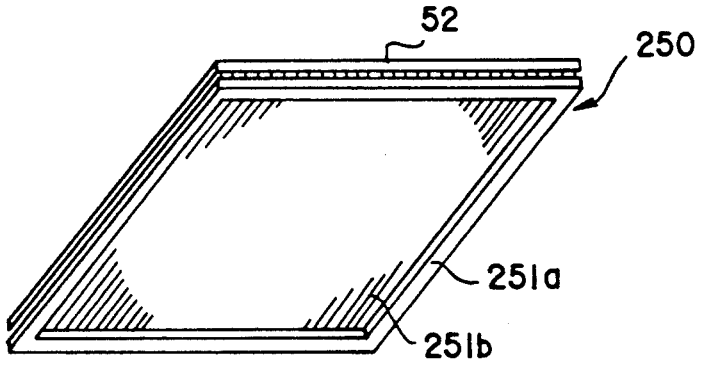
FIGS. 10A and 10B illustrate another modification of the water droplet collector shown in FIGS. 4A and 4B.
Figure 10B:
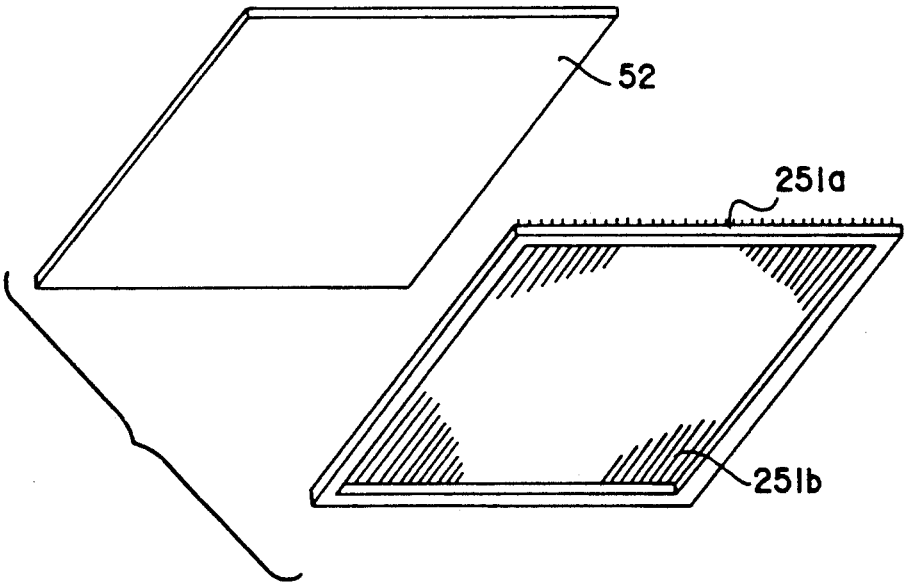
Figure 11A:
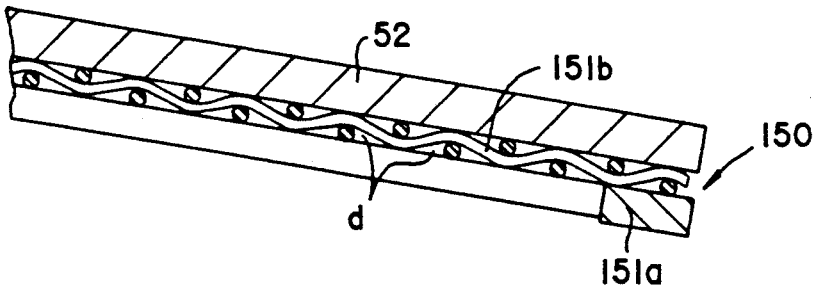
FIG. 11A is an enlarged sectional view of the water droplet collector shown in FIGS. 9A and 9B.
Figure 11B:
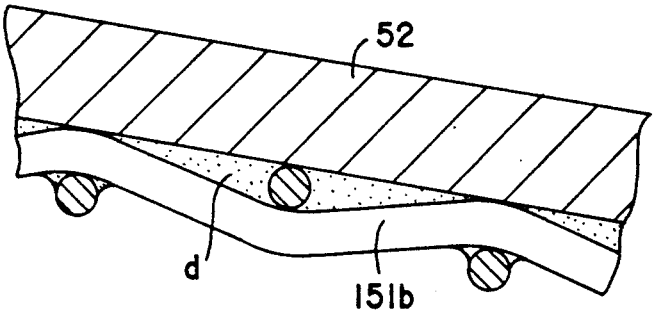
FIG. 11B is an enlarged sectional view illustrating drops of dew condensed from the air onto the water droplet collector shown in FIGS. 9A and 9B.
Figure 11C:
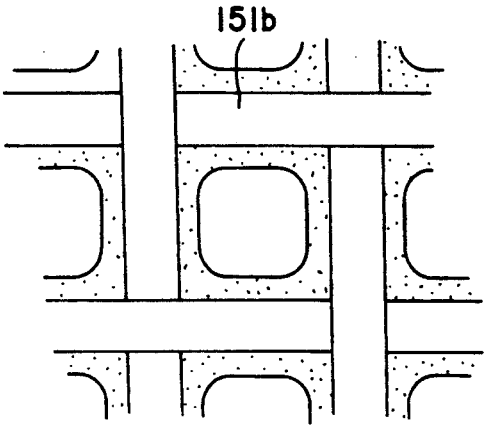
FIG. 11C is an enlarged plan view illustrating drops of dew condensed onto the water droplet collector shown in FIGS. 9A and 9B.

Although the water droplet collector 50 has been detachably carried on the support rails 61, 62 as shown in FIG. 1, the water droplet collector 50 may be detachably mounted to support brackets 63 fixed to the upper wall 21 of storage box 20 by means of fastening screws 64 as shown in FIGS. 7 and 8. In FIG. 9A there is illustrated a modification of the water droplet collector 50 wherein the perforated thin plate 51 is replaced with latticed wires 151*b* attached to a rectangular metallic or synthetic resin frame 151*a* as shown in FIG. 9B. In such a modified water droplet collector 150, capillary clearances d are formed between the latticed wires 151*b* and base plate 52 as shown in FIG. 11A. Thus, drops of dew condensed onto the latticed wires 150*b* are attracted into the capillary clearances d as shown in FIGS. 11B and 11C. In FIG. 10A there is illustrated another modification of the water droplet collector 50 wherein the perforated thin plate 51 is replaced with a number of parallel straight wires 251*b* secured to a rectangular metallic or synthetic resin frame 251*a* as shown in FIG. 10B. In such a modified water droplet collector 250, capillary clearances d are formed between the straight wires 251*b* and base plate 52 as shown in FIG. 12A. Thus, drops of dew condensed onto the straight wires 251*b* are attracted into the capi'lary clearances d as shown in FIGS. 12B and 12C.

Figure 13A:
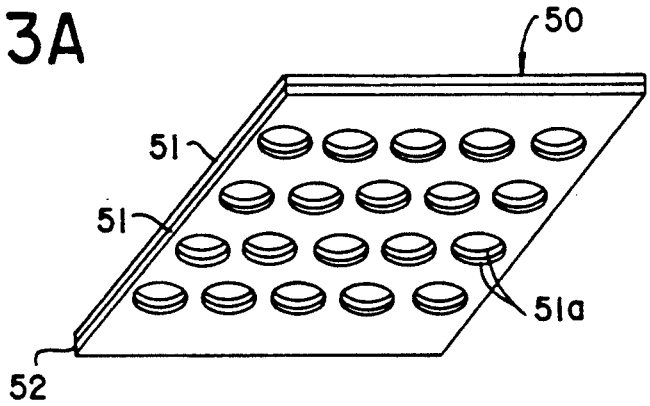
FIG. 13A is an enlarged perspective view of a further modification of the water droplet collector shown in FIGS. 4A and 4B.
Figure 13B:
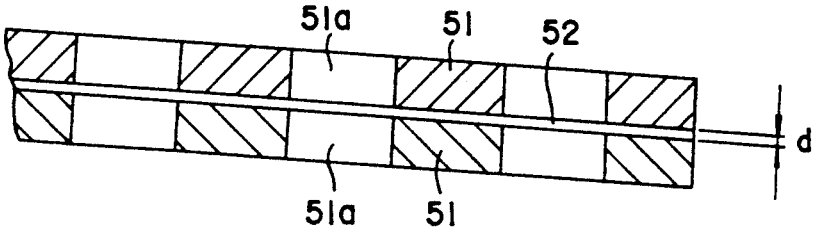
FIG. 13B is an enlarged sectional view of the water droplet collector shown in FIG. 13A.
Figure 14A:
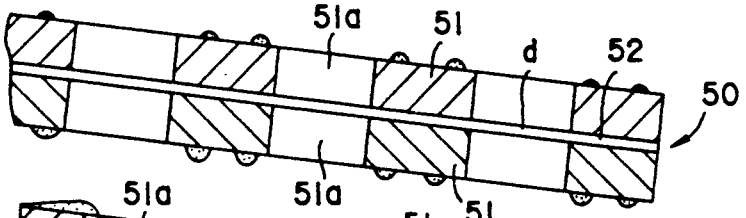
FIGS. 14A–14E illustrate a process from occurrence of drops of dew on the water droplet collector shown in FIGS. 13A and 13B to disappearance of the drops of dew.
Figure 14B:
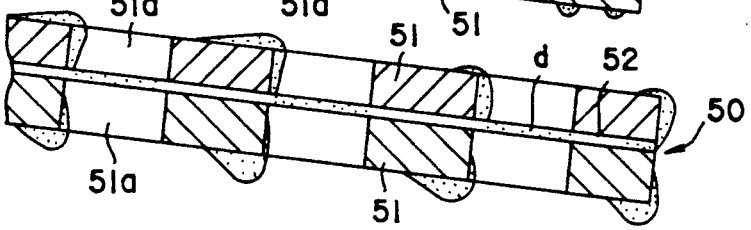
Figure 14C:
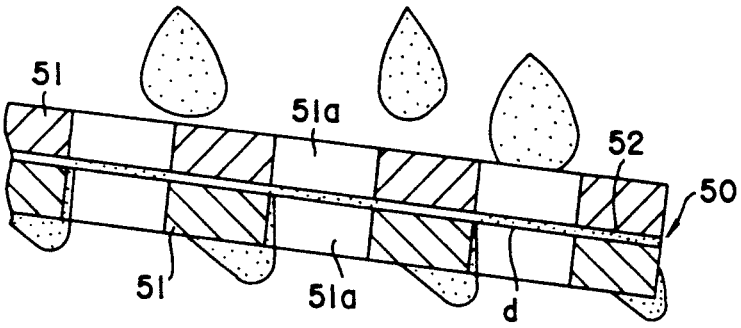
Figure 14D:
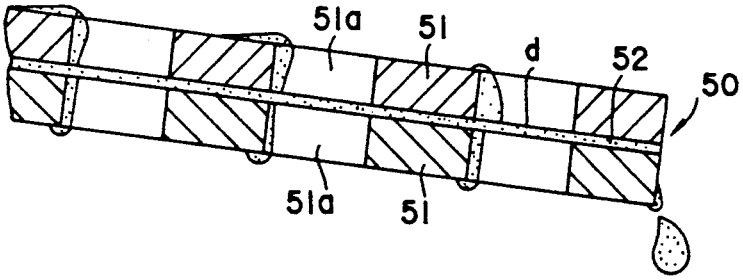
Figure 14E:
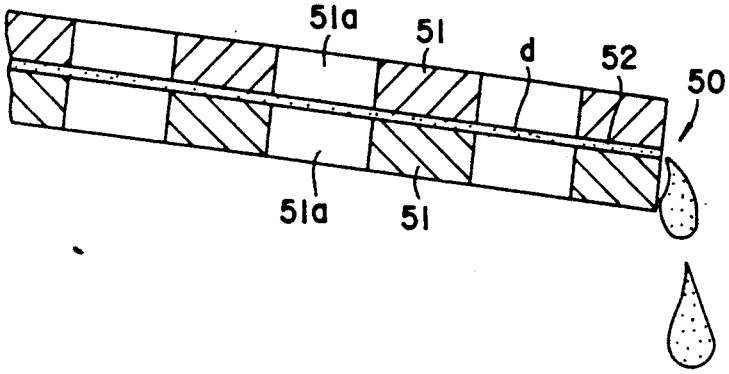

The water droplet collector 50 may be further modified as shown in FIGS. 13A and 13B, wherein the base plate 52 is replaced with a perforated thin plate 51 which is overlapped with the perforated thin plate 51 shown in FIG. 4A. A capillary clearance d is formed by the shim plate 53 between both the perforated thin plates 51. Assuming that moisture vaporized from the foodstuffs in the storage box 20 has been condensed as drops of dew onto the internal wall surfaces of storage box 20 and onto the water droplet collector 50, the drops of dew falling from the upper wall surface of box 20 are received by the upper surface of the water droplet collector 50 and attracted into the capillary clearance d between the perforated thin plates 51 as shown in FIGS. 14C and 14D. Drops of dew condensed on the water droplet collector 50 are attracted into the capillary clearance d together with the drops of dew falling from the upper wall surface of box 20 through holes 51*a* and flow toward the rear ends of plates 51 as shown in FIGS. 14A and 14B. Thus, the drops of dew falling from the rear ends of plates 51 flow down along the rear wall 24 of box 20 together with drops of dew condensed thereon to be drained from the storage box 20 through the drain pipe 29. At the bottom of water droplet collector 50, drops of dew condensed on the bottom surface of plate 51 are attracted into the capillary clearance d through holes 51*a* and flow rearward through the capillary clearance d toward the rear wall 24 of box 20 as shown in FIGS. 14C, 14D and 14E.

With the modified water droplet collector 50 shown in FIGS. 13A and 13B, the holes 51*a* of plates 51 permit the flow of cool air falling therethrough from the ceiling portion of storage box 20 toward the stored foodstuffs. This is effective to expedite the cooling speed in the storage box 20 and to uniform the temperature in the storage box 20. Although in the modified water droplet collector 50 shown in FIGS. 13A and 13B the perforated thin plates 51 have been overlapped in such a manner as to coincide their holes 51*a* to one another, the holes 51*a* in the upper plate 51 may be diametrically displaced relative to those in the lower plate 51. Alternatively, the holes 51*a* in the upper plate 51 may be formed different in diameter from those in the lower plate 51.

Figure 15A:
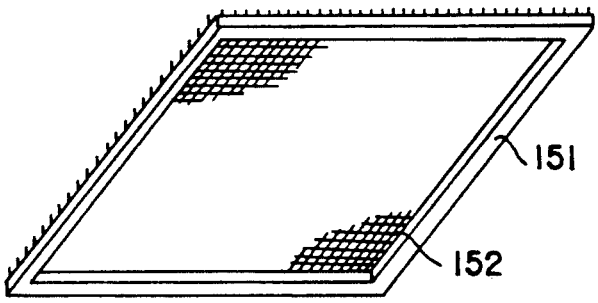
FIG. 15A is a perspective view of a variation of the water droplet collector shown in FIGS. 9A and 9B.
Figure 15B:
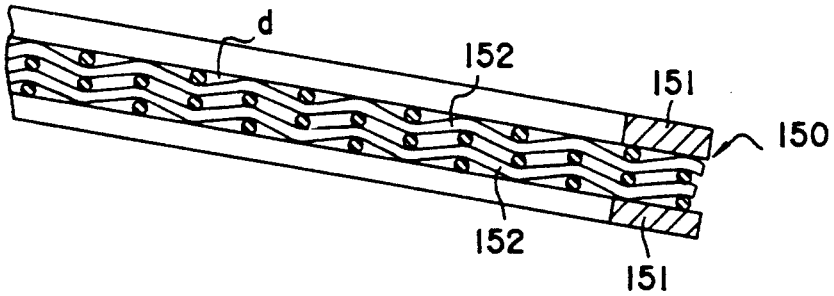
FIG. 15B is an enlarged sectional view of the variation shown in FIG. 15A.
Figure 15C:
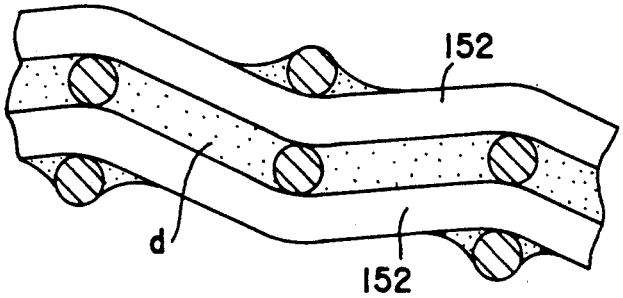
FIG. 15C is an enlarged sectional view illustrating drops of dew condensed onto the water droplet collector shown in FIGS. 15A and 15B.
Figure 16A:
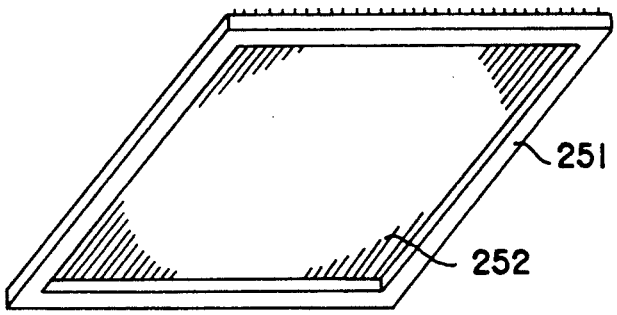
FIG. 16A is a perspective view of a variation of the water droplet collector shown in FIGS. 10A and 10B.
Figure 16B:
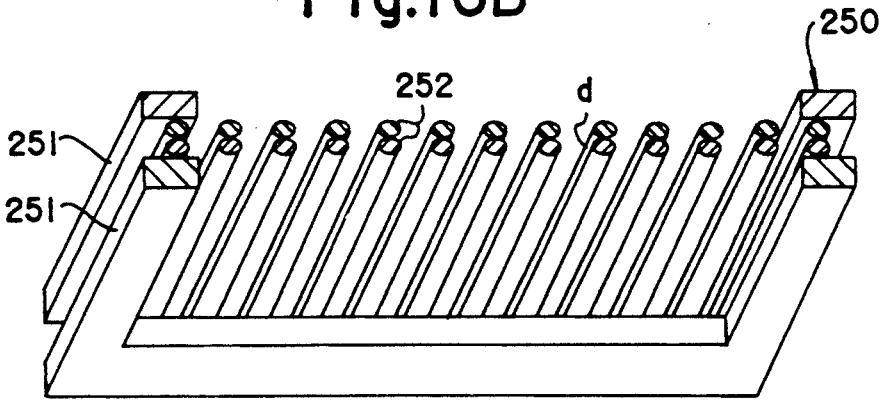
FIG. 16B is an enlarged sectional view of the variation shown in FIG. 16A.
Figure 16C:
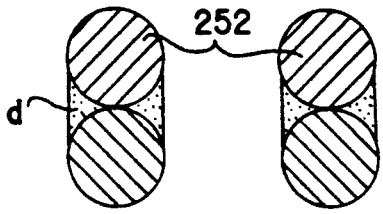
FIG. 16C is an enlarged sectional view illustrating drops of dew condensed onto the water droplet collector shown in FIGS. 16A and 16B.
Figure 18A:
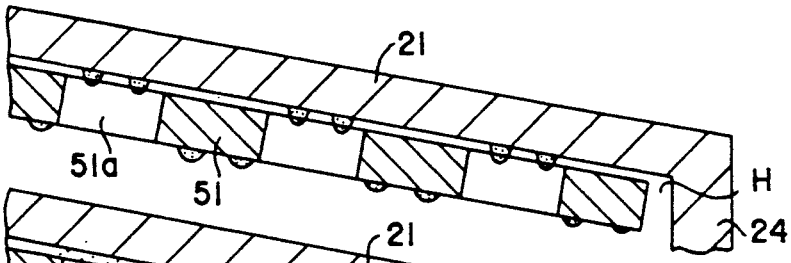
FIGS. 18A–18E illustrate a process from occurrence of drops of dew on the water droplet collector shown in FIG. 17 to disappearance of the drops of dew.
Figure 18B:
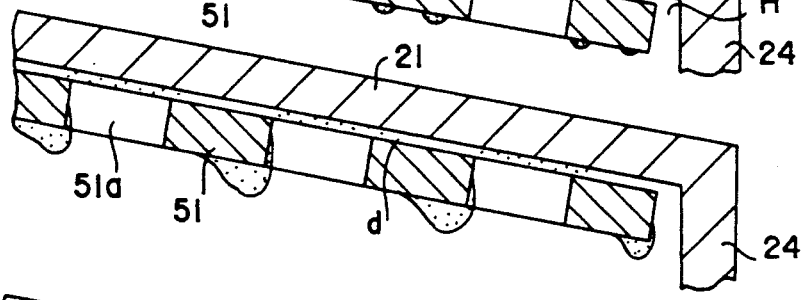
Figure 18C:
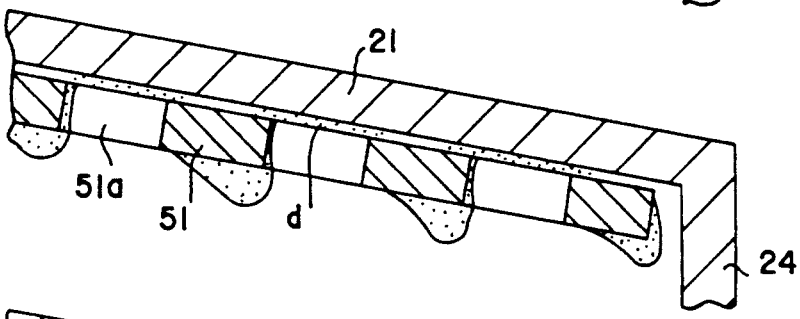
Figure 18D:
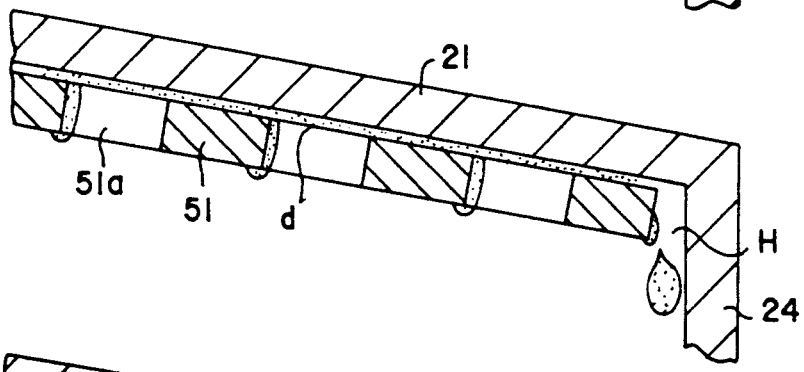
Figure 18E:
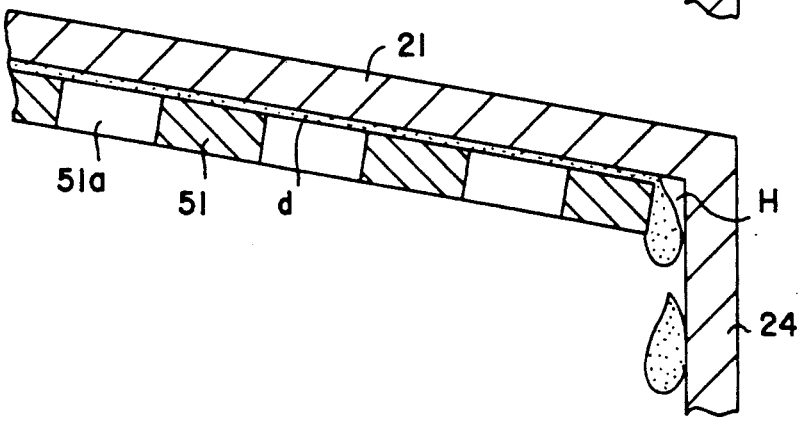

In FIGS. 15A and 15B there is illustrating another modification of the water droplet collector which is composed of latticed wires 152 of two layers fixedly supported by a pair of rectangular metallic or synthetic resin frames 151. In such a modification of the water droplet collector, capillary clearances d are formed between the latticed wires for attraction of water droplets adhered thereto as shown in FIGS. 15B and 15C. In FIGS. 16A and 16B, there is illustrated a further modification of the water droplet collector which is composed of parallel straight wires 252 of two layers fixedly supported by a pair of rectangular metallic or synthetic resin frames 251. In this modification, capillary clearances d are formed between the straight wires 252 for attraction of water droplets adhered thereto as shown in FIG. 16C.

Figure 17:
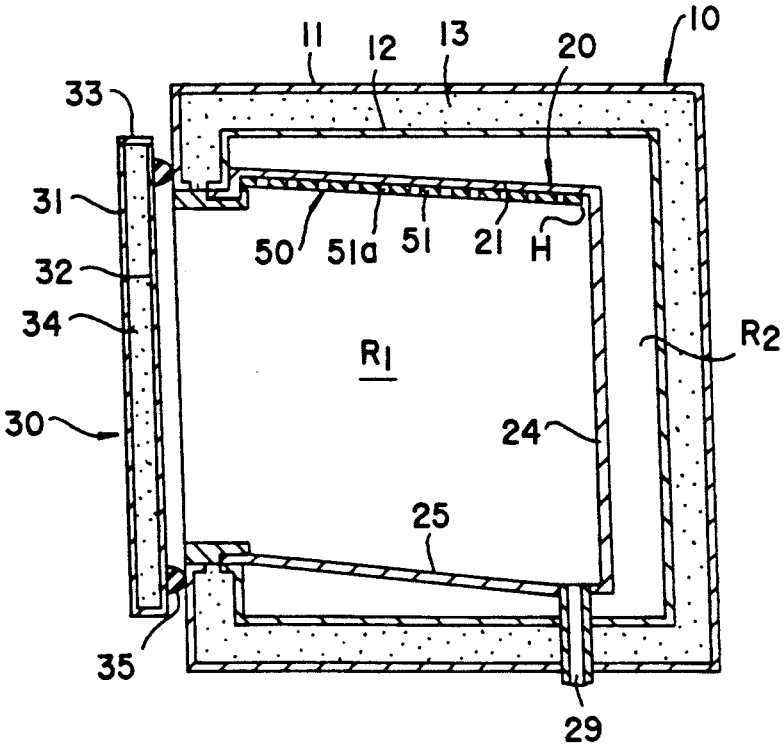
FIG. 17 is a sectional view of another emodiment of a high humid storage cabinet provided therein with a water droplet collector in accordance with the present invention.

In FIG. 17 there is illustrated a modification of the high humid cooling storage cabinet wherein the perforated thin plate 51 shown in FIG. 4A is detachably fixed to the upper wall 21 of storage box 20 and wherein a capillary clearance d is formed between the upper wall of storage box 20 and perforated thin plate 51 as shown in FIGS. 18A–18E. Formed between the rear end of plate 51 and the rear wall 24 of storage box 20 is a space H for permitting the flow of water droplets falling therethrough. Assuming that moisture vaporized from the foodstuffs in the storage box 20 has been condensed as drops of dew onto the internal wall surfaces of storage box 20 and the bottom surface of perforated thin plate 51, the drops of dew on the upper wall 21 of box 20 are attaracted into the capillary clearance d, while the drops of dew on the bottom surface of plate 51 are attracted into the capillary clearance d through holes 51*a* as shown in FIGS. 18A–18D. Thus, all the drops of dew flow rearward through the capillary cleanance d and fall from the rear end of plate 51 to be drain from the storage box 20 through the drain pipe 29. In this modification, the storage space R1 of box 20 can be enlarged in comparison with the storage cabinet shown in FIG. 1.

Figure 19:
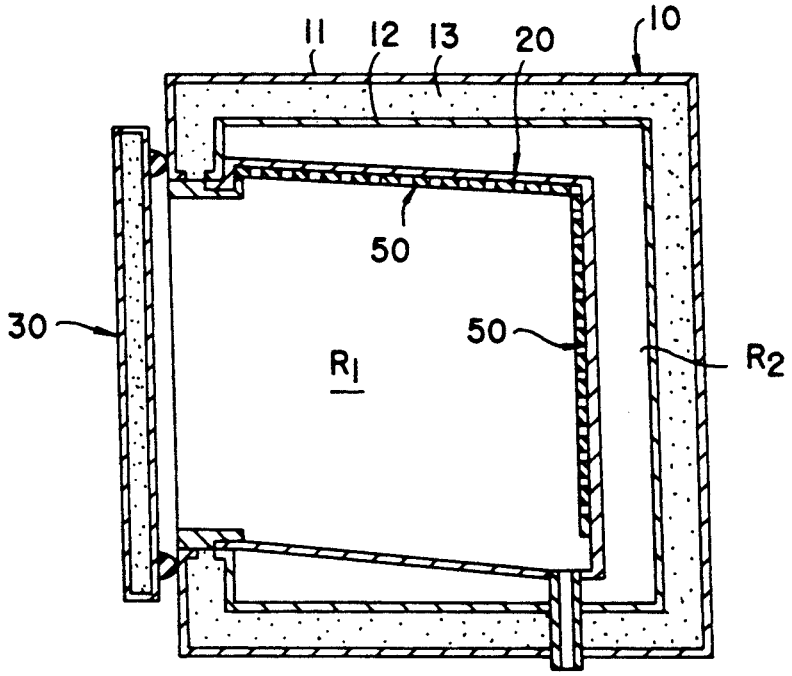
FIG. 19 is a sectional view of a modification of the storage cabinet shown in FIG. 17.
Figure 20:
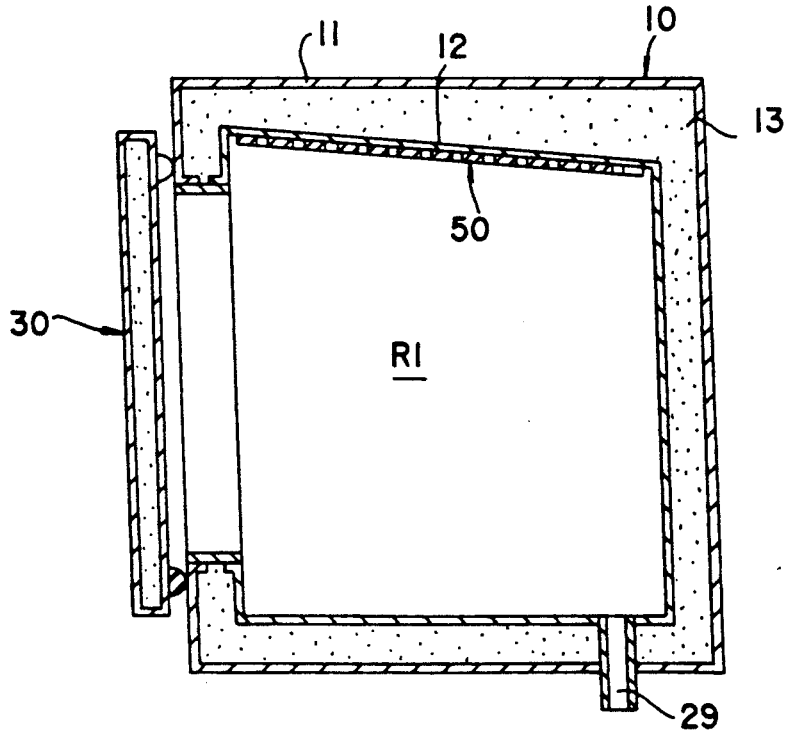
FIG. 20 is a sectional view of another modification of the storage cabinet shown in FIG. 17.

Although in the modification shown in FIG. 17 the perforated thin plate 51 has been fixed to the upper wall 21 of box 20, the perforated thin plate 51 may be further fixed to the rear wall 24 of box 20 as shown in FIG. 19. In the case that the storage cabinet 10 is constructed without the internal storage box 20 as shown in FIG. 20 to store therein foodstuffs together with ice, the perforated thin plate 51 may be fixed to the upper wall of internal box 12.

Having now fully set forth preferred embodiments of the concept underlying the present invention, various other embodiments as well as certain variations and modifications of the embodiments shown and described herein will obviously occur to those skilled in the art upon becoming familiar with said underlying concept. It is to be understood, therefore, that within the scope of the appended claims, the invention may be practiced otherwise than as specifically set forth herein.

What is claimed:

1. A water droplet collector for collecting drops of dew condensed from the air onto cool surfaces in a high humidity compartment such as a cooling storage cabinet formed to store foodstuffs therein, comprising:

a perforated plate having first and second surfaces; and a solid base plate overlapped with the first surface of said perforated plate so as to form a capillary clearance for attraction of drops of dew condensed on the second surface of said perforated plate, wherein both said plates are detachably mounted within said high humidity compartment and inclined at a predetermined angle toward an internal vertical side wall of said compartment such that said solid base plate is arranged to receive drops of dew falling from a ceiling of said compartment and that drops of dew attracted into the capillary clearance flow down toward the vertical side wall of said compartment to be drained away from a bottom of said compartment.

2. A water droplet collector as claimed in claim 1, wherein said base plate is detachably fixed to the first surface of said perforated plate with said capillary clearance.

3. In a cooling storage cabinet formed to store foodstuffs therein, a water droplet collector comprising:

a perforated plate detachably attached to an inclined upper wall of an internal storage space of said cabinet so as to form a capillary clearance for attraction of drops of dew condensed on said perforated plate, wherein said perforated plate is inclined along the upper wall of said storage space to flow down the drops of dew attracted into the capillary clearance toward an internal vertical side wall of said storage cabinet.

4. A water droplet collector for collecting drops of dew condensed from the air onto cool surfaces in a high humidity compartment such as a cooling storage cabinet formed to store foodstuffs, comprising:

a first permeable layer; and a second solid layer overlapped with said first permeable layer so as to form a capillary clearance for attraction of drops of dew condensed on said first permeable layer, wherein said first permeable layer and said second solid layer are detachably mounted within said high humidity compartment and inclined at a predetermined angle toward an internal vertical side wall of said compartment so that said second solid is positioned to receive drops of dew falling from a ceiling of said compartment and that drops of dew attracted into the capillary clearance flow down toward the internal vertical side wall of said compartment to be drained away from a bottom of said compartment.

* * * * *